US007908807B2

(12) United States Patent
Geilen

(10) Patent No.: US 7,908,807 B2
(45) Date of Patent: Mar. 22, 2011

(54) INSULATED CONCRETE FORM SYSTEM

(76) Inventor: Roy J. Geilen, St. Petersburg, FL (US)

( * ) Notice: Subject to any disclaimer, the term of this patent is extended or adjusted under 35 U.S.C. 154(b) by 1334 days.

(21) Appl. No.: 11/363,013

(22) Filed: Feb. 27, 2006

(65) Prior Publication Data

US 2007/0199266 A1 Aug. 30, 2007

(51) Int. Cl.
*E04C 1/00* (2006.01)

(52) U.S. Cl. ..... 52/309.12; 52/309.11; 52/309.17; 52/426; 52/439

(58) Field of Classification Search ..... 52/424, 52/425, 426, 295, 309.11, 309.12, 309.17, 52/334, 427–432, 439, 606, 607
See application file for complete search history.

(56) References Cited

U.S. PATENT DOCUMENTS

| | | | | |
|---|---|---|---|---|
| 3,566,568 | A | 3/1971 | Slobodian | |
| 4,038,798 | A | 8/1977 | Sachs | |
| 4,249,354 | A | 2/1981 | Wynn | |
| 4,532,745 | A * | 8/1985 | Kinard | 52/251 |
| 4,823,534 | A | 4/1989 | Hebinck | |
| 5,377,470 | A | 1/1995 | Hebinck | |
| 5,566,521 | A | 10/1996 | Andrews et al. | |
| 5,657,600 | A * | 8/1997 | Mensen | 52/426 |
| 5,839,243 | A | 11/1998 | Martin | |
| 6,164,035 | A | 12/2000 | Roberts | |
| 6,185,891 | B1 | 2/2001 | Moore | |
| 6,205,726 | B1 | 3/2001 | Hoadley | |
| 6,305,142 | B1 | 10/2001 | Brisson et al. | |
| 6,519,904 | B1 | 2/2003 | Phillips | |
| 6,739,102 | B2 | 5/2004 | Roy, Sr. | |
| 6,848,228 | B1 | 2/2005 | Williams | |
| 2002/0017070 | A1 | 2/2002 | Batch | |
| 2004/0045237 | A1 * | 3/2004 | Coombs et al. | 52/309.11 |

* cited by examiner

*Primary Examiner* — Brian Glessner
*Assistant Examiner* — William V Gilbert

(57) ABSTRACT

An insulated concrete form system for constructing the exterior walls and gable ends of a structure is disclosed using expanded polystyrene forms that interconnect and are bonded to each other and to the structure's slab or foundation with concrete. Internal, substantially columnar voids are provided in each of the panel forms and both the interior and the exterior surfaces of the walls and gable ends may be finished with a variety of finish materials using furring strips that are incorporated into the interior and exterior surfaces of the forms.

5 Claims, 5 Drawing Sheets

INSULATED CONCRETE FORM SYSTEM

BACKGROUND OF THE INVENTION

1. Field of the Invention

The present invention relates to an insulated concrete form system for constructing the exterior walls and gable ends of a structure on an existing slab or foundation. The concrete form system includes wall panels, corner panels, and gable panels, all preferably formed from expanded polystyrene (EPS). Voids are provided in the panels for the introduction of concrete, thereby providing structural integrity for the resulting structure.

2. Description of the Prior Art

Since at least as early as the 1950's, it has been known to use foamed plastic blocks for the construction of various structures. Such blocks typically interlock one with another and include various forms of voids formed therein to receive a concrete slurry, providing structural integrity. Most such blocks are formed from EPS, and the prior art also teaches covering the outer skins of the blocks with oriented strand board to provide what is known in the trade as a structural insulated panel.

The foam core itself is not load-bearing. Rather, the structure is supported by the columns and beams formed by the introduction of concrete. However, the presence of the EPS panels significantly enhances the insulating properties of the resulting structure as a result of the low thermal conductivity of EPS.

It is also recognized that the labor costs associated with erecting a structure employing EPS panels may be significantly reduced because of the ease of erecting the light weight panels in preparation for the structural concrete pour. Window and door openings can be pre-cut, and even electrical and plumbing chases can be pre-formed in the panels before delivery to the construction site.

Notwithstanding the generally positive evaluations of insulated concrete form building systems and materials, the use of EPS building forms still represents a relatively small segment of the construction industry. Perhaps due to the complexity of existing systems, most of the construction industry has been reluctant to adopt and utilize these methods and techniques. It is therefore clear that there remains a need for an insulated concrete form building system that retains the advantages associated with the use of EPS panels while preserving not only the structural integrity of the building and the superior insulating characteristics obtained by such a building, but also providing for even easier and faster erection of the structure.

SUMMARY OF THE INVENTION

The present invention relates to an insulated concrete form system for constructing exterior walls and gable ends of a structure on an existing slab or foundation. The system comprises a plurality of wall panels disposed about the perimeter of the existing slab or foundation and extending upwardly therefrom. Corner panels are disposed at each corner defined by the perimeter of the structure and extend upwardly therefrom in inter-connecting relation between adjacent wall panels. A plurality of gable panels are disposed on each one of an opposite pair of exterior walls and extend upwardly therefrom to define gable ends of the structure. Columnar voids are provided in each of the panels to receive concrete slurry, and the wall panels and gable panels include beam voids at their respective tops, also to receive concrete slurry.

The slab or foundation is designed and constructed in accord with engineering specifications determined by the building site. Rebar segments are disposed in and extend upwardly from the slab, about its perimeter, and are utilized as set forth in greater detail hereinafter to obtain structural integrity in accord with design specifications.

In a preferred embodiment for the insulated concrete form system of this invention, the EPS panels each have a thickness of about 10 inches, are about 48 inches wide, and have a height of 96 inches or 108 inches depending upon building specifications. Tongue and groove configurations are cut into opposed side edges of each panel to assist in erecting the walls of the structure by interlocking adjacent panels with opposed tongues and grooves. An expanding foam adhesive may be applied to the interlocking joints, and rebar is disposed within the columnar voids of the panels and the beam voids of the panels to ensure structural integrity in accord with design specifications. Of course, the rebar is placed in those voids prior to the concrete pour, and the rebar within the columnar voids is mechanically fixed to the rebar segments extending from the slab or foundation, all according to standard construction techniques.

Windows and doors may be pre-cut in the wall panels before delivery to the site, and electrical and plumbing chases may also be pre-formed according to the building specifications.

Finally, it should be noted that both the interior and exterior surfaces of the panels are provided with furring strip recesses for the placement of furring strips thereon as the exterior walls and gable ends of the structure are formed. Furring strips on the exterior surfaces permit the addition of virtually any desired exterior appearance, and the furring strips on the interior surfaces provide for the attachment of interior finish such as, for example, wall board.

The preferred rebar is #5, and the post and beam voids are filled with 3000 psi concrete including three eighths pea gravel aggregate. Beam cavities at the exposed tops of the wall panels and gable panels are provided with hurricane straps that are inserted into the wet concrete in accord with the specified roof joist system.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
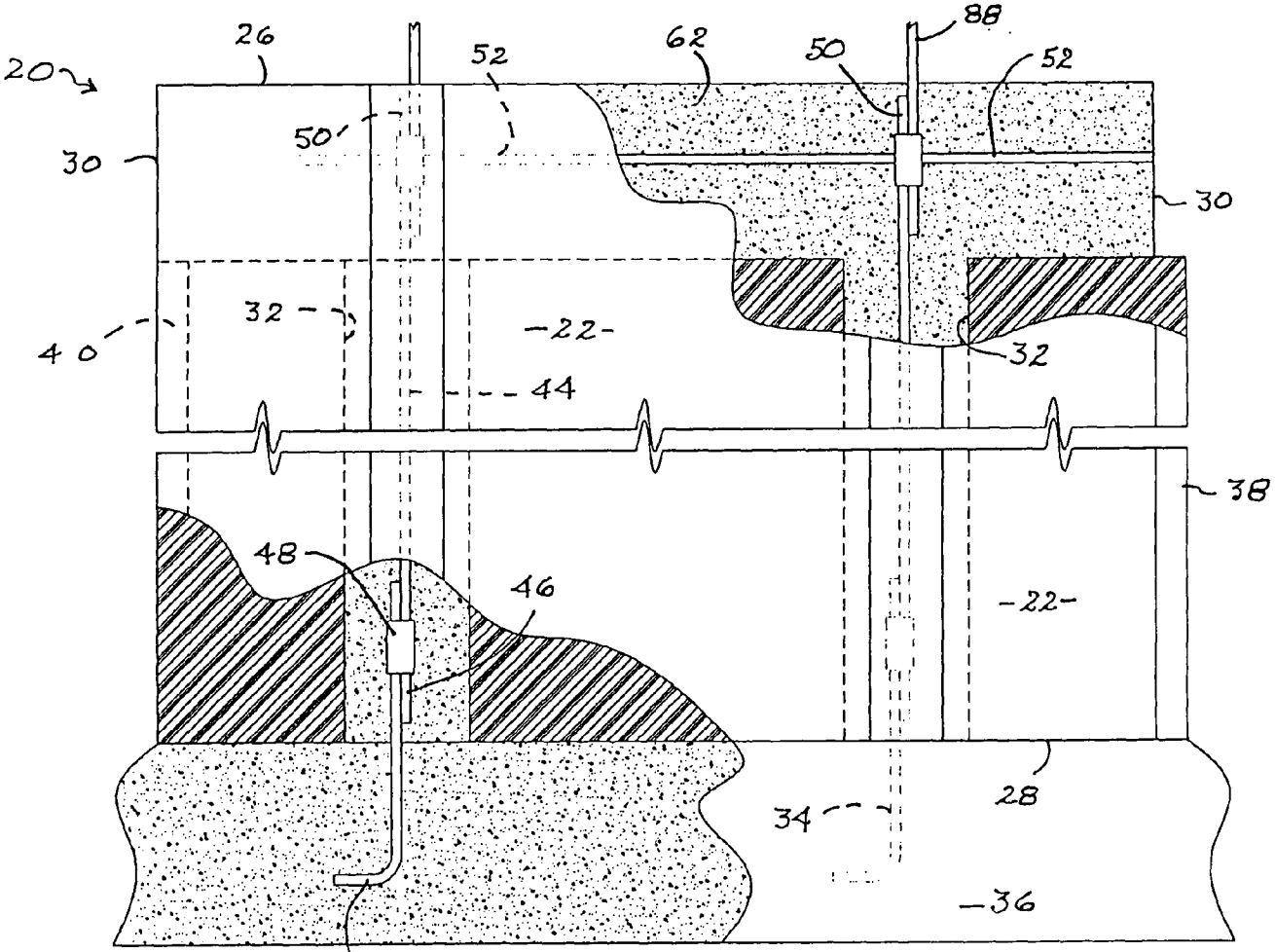
FIG. 1 is an elevation, partially in section, of the wall panel.
Figure 2:
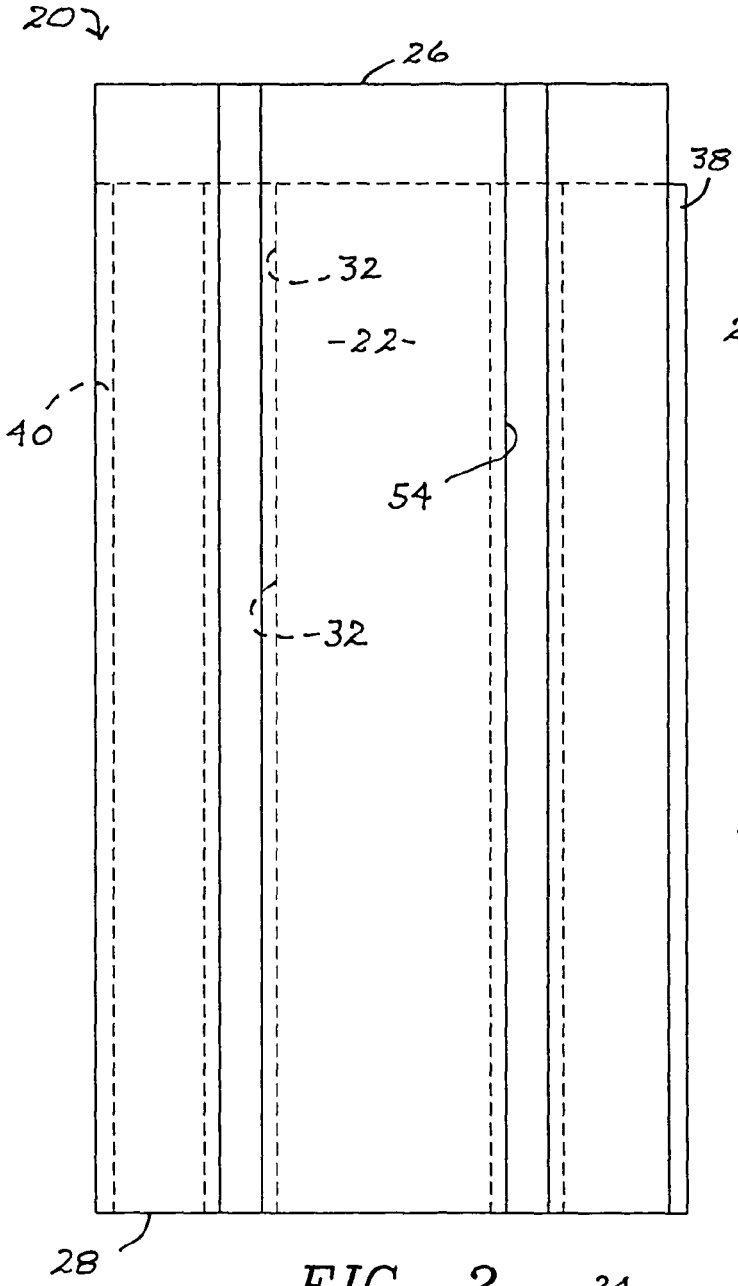
FIG. 2 is an elevation of the wall panel shown in FIG. 1.
Figure 3:
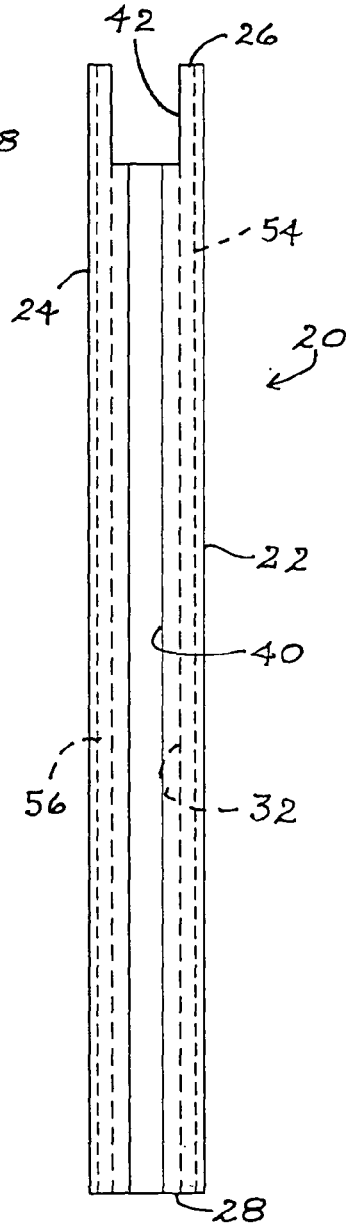
FIG. 3 is a left side elevation of the wall panel of FIG. 2.
Figure 4:
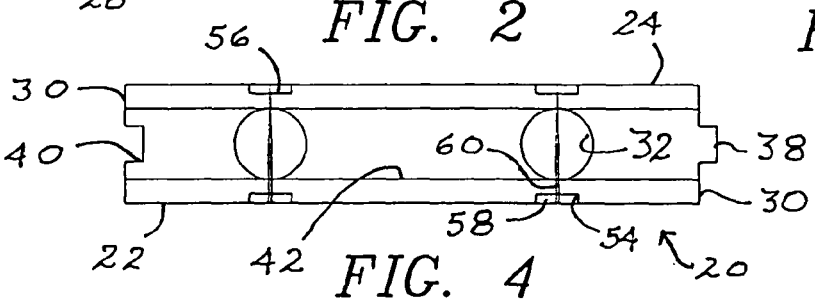
FIG. 4 is a top plan view of the wall panel of FIG. 2.
Figure 5:
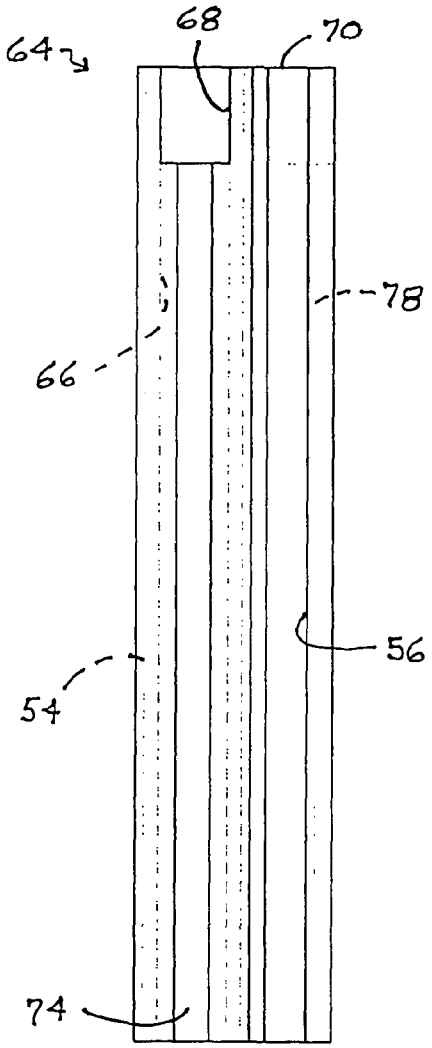
FIG. 5 is a side elevation of a corner panel.
Figure 7:
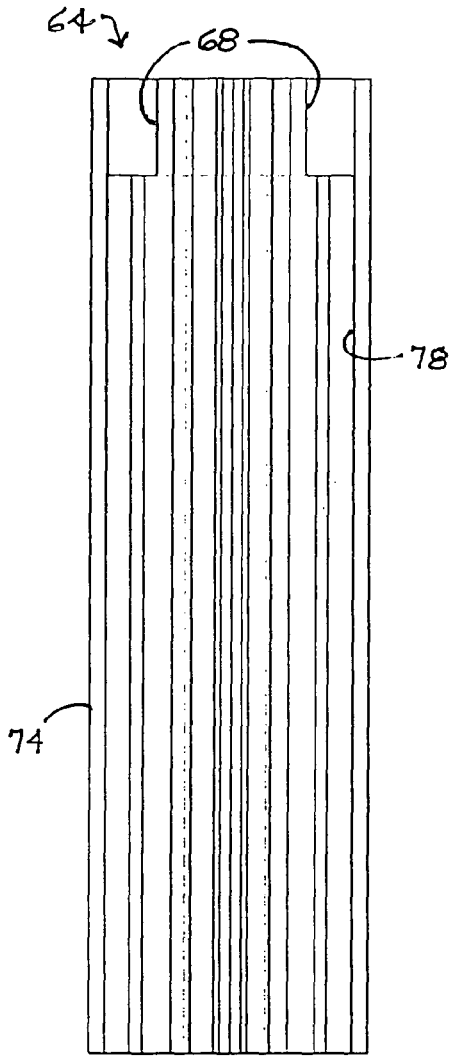
FIG. 7 is an interior side elevation of the corner panel.

Referring first to the views of FIGS. 1-4, a wall panel of the present invention is generally indicated as 20. Each of the wall panels 20 have an exterior wall surface 22 and an interior wall surface 24 both being a part of a single solid panel 20. Wall panels 20 are formed from EPS, and are defined by a top edge 26, a bottom edge 28, and opposed side edges 30. As best seen in the views of FIGS. 1 & 4, columnar wall voids 32 are formed within the wall panels 20 and extend from bottom edge 28 upwardly through top edge 26. As clearly show in the view of FIG. 1, the columnar wall voids 32 are disposed so a to be in registry with slab rebar segments 34 that are disposed within slab or foundation 36. Slab rebar segments 34 are typically J-bar segments as show in the view of FIG. 1.

As perhaps best seen in the plan view of FIG. 4, side edges 30 further comprise a tongue 38 on one of the se edges 30 and a corresponding groove 40 formed in the other of the side edges. Thus, adjacent ones of the wall panels 20 may be joined to each other by inserting tongue 38 of one panel 20 into groove 40 of an adjacent panel 20. Adhesive (not shown) may be applied to tongue 38 and/or groove 40 to enhance the bond between adjacent panels 20.

Referring to the side view of FIG. 3, it can be seen that each of the wall panels 20 further comprises a beam cavity 42 formed along the top edge 26. As shown in the view of FIG. 1, beam cavity 42 is in fluid communication with each of the columnar wall voids 32.

Figure 10:
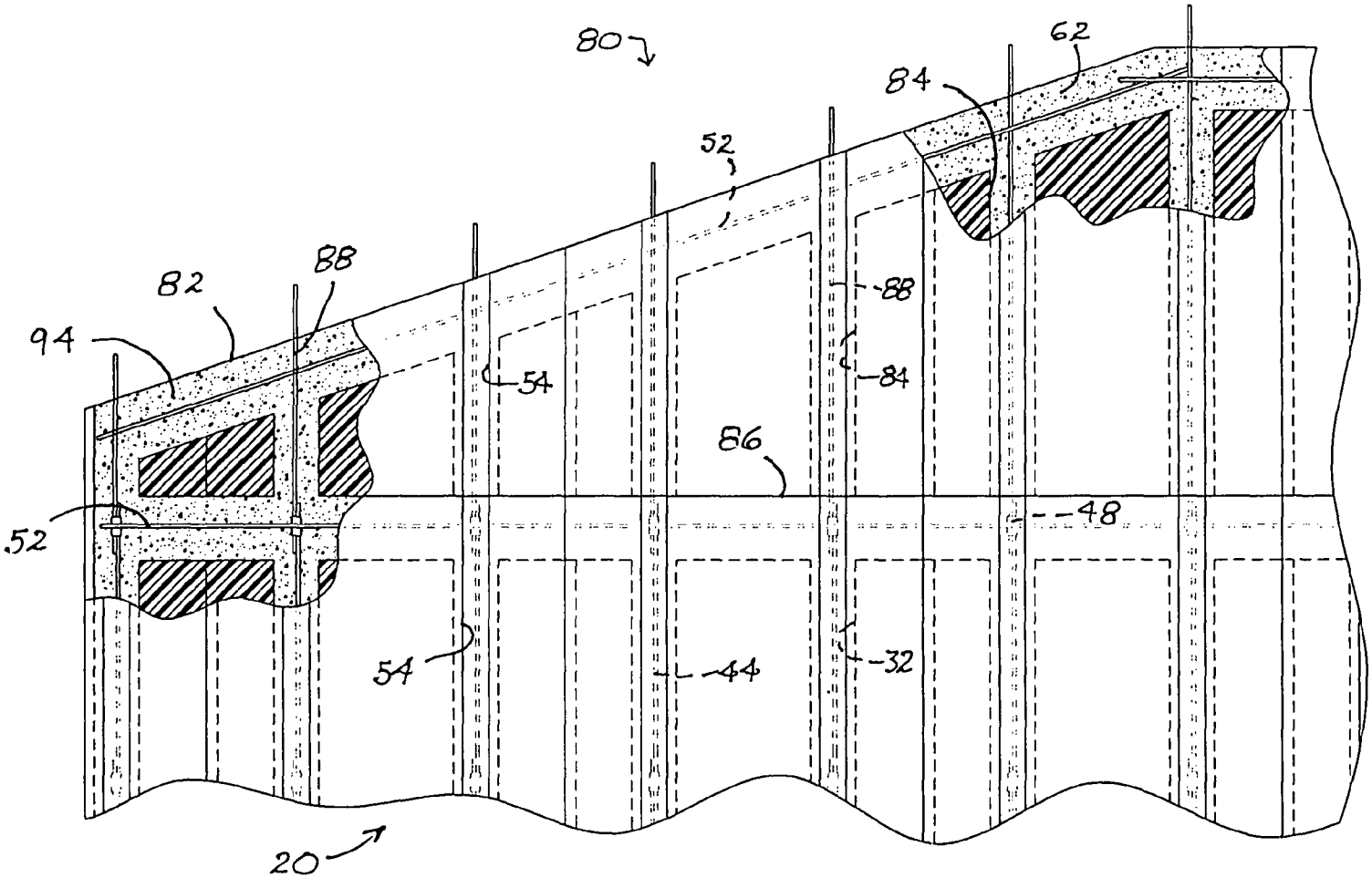
FIG. 10 is a partial sectional elevation of a segment of the wall panels and gable panels shown in FIG. 9.

Wall panels 20 are placed on slab or foundation 36 as show in the view of FIG. 1. An adhesive may be applied to slab or foundation 36 and bottom edge 28 of the wall panels, if desired. However, structural integrity is provided by the use of wall panel reinforcers 44. A preferred form for wall panel reinforcers 44 is number 5 rebar segments as shown in the view of FIGS. 1 & 10, beam rebar 52 is placed within beam cavity 42, the number and size as required for the structural design, and mechanically fastened by to second end 50 of each of the wall panel reinforcers 44, which end is formed in an L-shape, according to known construction techniques for the purposes of structural integrity.

External furring strip recess 54 are formed on exterior wall surface 22, and internal furring strip recesses 56 are formed on interior wall surface 24. As seen in the view of FIG. 4, external furring strip recesses 54 and internal furring strip recesses 56 extend in parallel relation to the longitudinal axis of the corresponding wall void 32 and, as clearly seen in the view of FIG. 2, extend from bottom edge 28 to the top edge 26. Furring strips 58 of any suitable material, preferably wood or light gauge metal are mounted within each of the recess 54 and 56 to provide for attachment of exterior surfacing and interior finishing. As illustrated in the view of FIG. 4, furring strips 58 are preferably attached using through panel 20 screws 60 that extend into and through the wall void 32. Furring strips 58 and screws 60 are installed prior to the pour of concrete 62 so that opposing furring strips 58 actually function as forms to restrain concrete 62 from bulging as wall voids 32 are filled. It is also to be understood that an adhesive may be utilized for the purpose of providing additional attachment of furring strips 58 within their respective furring strip recesses 54 and 56.

In the views of FIGS. 5-8, illustrations of the corner panels, generally indicated at 64, are provided. Like wall panels 20, corner panels 64 are formed from EPS, and each of the corner panel 64 comprises a columnar corner void 66 formed therethrough just as the above description for wall voids 32. It can also be seen, particularly in the views of FIGS. 5-7, that a corner beam cavity 68 is provided along the corner top edge 70. One side edge 72 of corner panel 64 includes a corner tongue 74 formed theron, and the opposite side edge 76 of corner panel 64 includes a corner groove 78 formed therein. This construction permits the placement and attachment of wall panels 20 on each side of the corner panels 64. Though not shown in the drawings it is to be understood that the corner panels 64 are disposed on slab or foundation 36 at the corners thereof such that the slab rebar segments 34 extend upwardly and into a corresponding corner void 66. Corner panel reinforcers corresponding to wall panel reinforces 44 are inserted into each of the corner voids 66 prior to the concrete pour, as described above with regard to wall panels 20. Also as previous described with regard to wall panels 20, structure corresponding to beam rebar 52 is similarly disposed in each corner beam cavity 68 in accord with the description provided above concerning beam rebar 52.

It is to be understood that while corner panels 64 are shown in the drawing figures as defining a 90 degree angle, this is not to be considered limiting to the scope of the invention. Depending upon the design configuration of the structure, corner panels 64 may describe angles of greater or lesser than 90 degrees and may even be arcuate.

Figure 6:
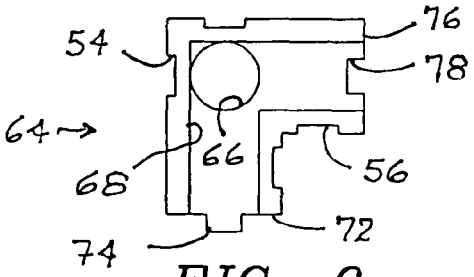
FIG. 6 is a top plan view of the corner panel of FIG. 5.
Figure 8:
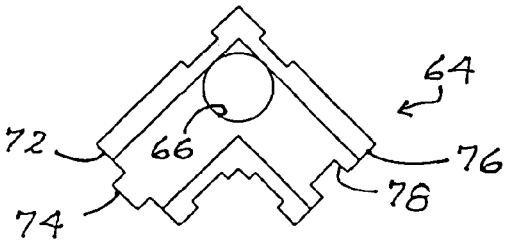
FIG. 8 is a top plan view of the corner panel of FIG. 7.

As perhaps best seen in the view of FIGS. 6 & 8, corner panel 4 further comprises external furring strip recesses 54 and internal furring strip recess 56 substantially as described above with respect to wall panels 20.

Figure 9:
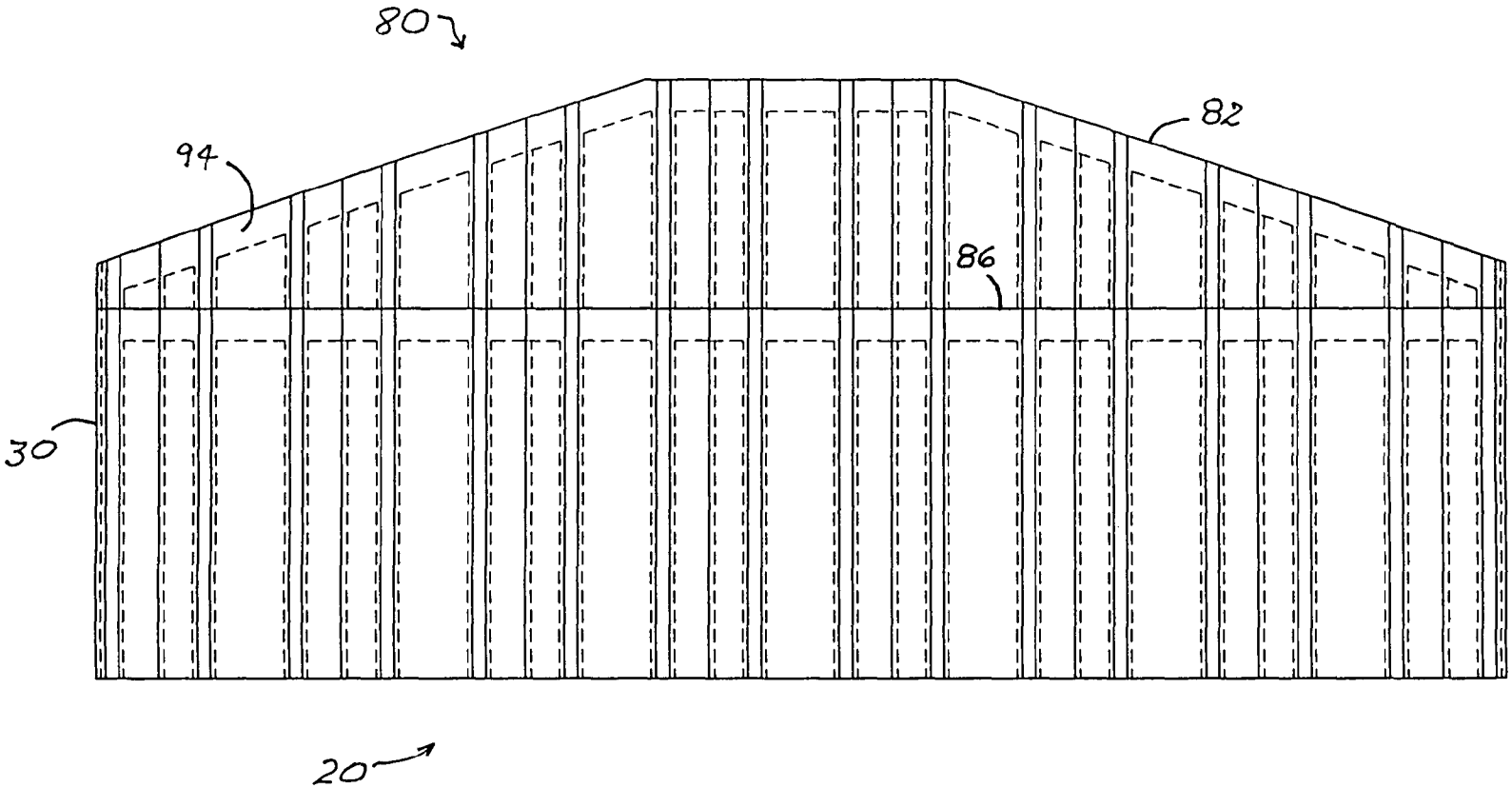
FIG. 9 is an elevation of a plurality of wall panels having a plurality of gable panels attached thereto.

Turning now to the views of FIGS. 9 & 10, the plurality of the gable panels, generally indicated as 80, are shown as being operatively positioned above the plurality of wall panels 20 to define able ends of the structure with columnar voids 32 aligned with the columnar voids 32 of the wall panels. Each of the gable panels 80 is formed of EPS, but specific sizes and a pitch of each gable top edge 82 are determined by building specifications. Also dependent upon size and building specifications, each of the gable panels 80 does comprise at least one substantially columnar gable void formed vertical therethrough as previously described with regard to columnar wall voids 32 and columnar voids 66. As best seen in the view of FIG. 10, gable bottom edge 86 rests on a corresponding top edge 26 of wall panel 20, and a gable panel reinforcer 88 is disposed with each of the gable voids 84, providing the roof connection through the foundation connection by the reinforcers contained in voids 32, 66 and 88 all tied into beam reinforcers attached below in each respective panel 20. Referring to the views of FIGS. 1 and 10, it can be seen that a first end 90 of each gable panel reinforcer 88 is attached to the end of a corresponding wall panel reinforcer 44 and that second end 92 reinforcer of gable panel reinforcers 88 extends upwardly th(r)ough gable beam cavity 94. Beam rebar 52 is disposed within babe beam cavity 94 for structural integrity as described above with respect to all panels 20. Furring strips recesses are provided in each of the gable panels 80, though the views of FIGS. 9 & 10 only show internal furring strip recesses 56. It is also to be understood that the outer most ones of the gable panels 80, termed gable end panels, would include structure corresponding to either tongue 38 or groove 40 on the inner edge thereof for mating with corresponding structure provided on opposite sides of the intermediate gable panels disposed between the pair of gable end panels at each end of the gable wall. It is also to be understood that adhesive may be used between gable bottom edges 86 and wall top edges 26, and that adhesive may similarly be used for placing furring strips within the furring strip recesses formed on the gable panels.

Having thus set forth a preferred construction for the insulated concrete form system of this invention, it is submitted that utilization of this system not only permits extremely efficient erection of the walls and gable ends of a structure as compared to the state of the art, but also provides a structure that exhibits enhanced characteristics of both structural and higher insulation properties due to its retention of more EPS mass in its post and beam configuration. Utilizing the system of this invention, perimeter walls and gable ends are uniquely resistant to heat or cold transfer, with the only points of such transfer actually being windows and doors, which, of course, can be properly insulated. While not described and claimed as a part of this invention, it is to be understood that a roofing system, properly designed by a professional engineer or architect, would be added and to the roof system would preferably include EPS panels extending across the roof truss rafters and then sheathed with enhanced roofing materials and vents.

While the above detailed description of a preferred embodiment has been provided for setting for the nature of this invention to those skilled in the art, it is to be understood that modification of the specific examples given may be made and that such modifications are intended to come within the scope of this invention. For example, and as discussed above, the corner panels of this invention are not limited to 90 degree corners, but may be constructed as desired, in accord with the building specifications. In similar fashion, while wall corner and gable panels formed from EPS of about 10 inch thickness are preferred, neither the thickness of the material nor the specific use of EPS is intended to limit the scope of this invention. Other materials, such as, for example, structural insulated panels, might be used, and the actual thickness of each panel might be greater or lesser than the preferred 10 inches, depending upon the location and use of the structure being built. Furthermore, while the above description has acknowledged that electrical and plumbing chases may be pre-formed in the panels, the chases may also be cut at the construction site using a hot wire tool or a router, both of which are well known in the construction industry.

It will thus be seen that the objects sent forth above, among those made apparent from the preceding description, are efficiently attained and, since certain changes may be made in the above panels, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Now that the invention has been described,

What is claimed is:

1. An insulated concrete form system for constructing the exterior walls and gable ends of a structure on an existing slab or foundation defining a perimeter of the structure and having a plurality of rebar segments disposed in and extending upwardly from the slab or foundation in predetermined, spaced apart relation to each other around the perimeter of the structure, said insulated concrete form panel system comprising: a plurality of substantially solid wall panels having an exterior wall surface and an interior wail surface disposed about the perimeter of the existing slab or foundation and extending upwardly therefrom to define said exterior walls of the structure, a plurality of corner panels having an exterior corner and an interior corner surface of one panel, one of said plurality of corner panels being disposed at each corner defining the perimeter of the structure and extending upwardly therefrom in interconnecting relation between an adjacent pair of said wall panels, and a plurality of gable panels having an exterior gable surface and an interior gable surface, at least one of said plurality of gable panels being disposed on each one of the opposed pair of said exterior walls and extending upwardly therefrom to define said gable ends of the structure, each said wall panel further comprising a tongue in a first lateral edge and corresponding groove in a second opposite lateral edge, each said wall panel, said gable panel and said corner panel further comprising a columnar void extending from a third lateral edge to a fourth lateral edge, a plurality of furring strips received in recesses spaced along said exterior and interior surfaces of said wall panel, said corner panel and said gable panel, and at least one screw member connecting a first furring strip on said respective exterior surface to a second furring strip on said respective interior surface, said screw passing through said void.

2. An insulated concrete form system as in claim 1 wherein each one of said plurality of wall panels is formed from EPS, each said void formed therein and extending from said third edge through said fourth edge such that each of said columnar wall voids is in registry with one of the rebar segments extending upwardly from the slab or foundation, each one of said panels further comprising a beam cavity formed along said third edge.

3. An insulated concrete form system as in claim 2 wherein each one of said plurality of corner panels is formed from EPS, said columnar corner void is in registry with one of the rebar segments extending upwardly from the slab or foundation, each one of said corner panels further comprising a corner beam cavity formed along said corner third edge, one of said corner side edges comprising a corner tongue and the other of said corner side edges comprising a corner groove whereby adjacent ones of said wall panels may be joined to said corner panel by inserting said tongue of one wall panel side edge into said corner groove and disposing said groove of said adjacent wall panel onto said corner tongue.

4. An insulated concrete form system as in claim 3 wherein each of said gable panels is formed from EPS, each of said columnar gable voids is in registry with one of said columnar wall voids, each of said gable further comprising a gable beam cavity formed along said gable third edge.

5. An insulated concrete panel form system as in claim 4 further comprising a plurality of wall and corner panel reinforcers each having a first end and a second end, said first end of each of said plurality of wall and corner panel reinforcers being attached to a corresponding one of the rebar segment extending from the slab or foundation, passing through its corresponding wall void or corner void, and said second end of each one said wall and corner panel reinforcers extending into its corresponding beam cavity, said system further comprising a plurality of gable reinforcers each having a lower end and an upper end, said lower end of each one of said gable reinforcers being attached to a corresponding second end of one of said wall reinforcers, passing through its corresponding gable void, and said upper end of each one of said gable reinforcers extending into its corresponding gable beam cavity; and said system further comprising horizontal reinforcers disposed within said corner beam cavity and said gable beam cavity whereby concrete may be placed in said wall voids, said corner voids, said gable voids, said beam cavities, said corner beam cavities, and said gable beam cavities to bond said exterior walls and said gable ends of the structure to each other and to the slab or foundation.

* * * * *